US011621494B2

(12) United States Patent
Lebayon

(10) Patent No.: US 11,621,494 B2
(45) Date of Patent: Apr. 4, 2023

(54) FEED FOR AN ANTENNA SYSTEM COMPRISING A SUB-REFLECTOR AND A MAIN REFLECTOR

(71) Applicant: Nokia Shanghai Bell Co., Ltd., Shanghai (CN)

(72) Inventor: Armel Lebayon, St. Brevin les Pins (FR)

(73) Assignee: Nokia Shanghai Bell Co., LTD., Shanghai (CN)

( * ) Notice: Subject to any disclaimer, the term of this patent is extended or adjusted under 35 U.S.C. 154(b) by 0 days.

(21) Appl. No.: 17/479,241

(22) Filed: Sep. 20, 2021

(65) Prior Publication Data

US 2022/0094066 A1 Mar. 24, 2022

(30) Foreign Application Priority Data

Sep. 21, 2020 (FI) ..... 20205911

(51) Int. Cl.

| | |
|---|---|
| ***H01Q 13/02*** | (2006.01) |
| ***H01Q 19/18*** | (2006.01) |
| ***H01Q 19/19*** | (2006.01) |
| ***H01Q 19/13*** | (2006.01) |

(52) U.S. Cl.

CPC ..... *H01Q 13/02* (2013.01); *H01Q 19/134* (2013.01); *H01Q 19/18* (2013.01); *H01Q 19/193* (2013.01)

(58) Field of Classification Search

CPC ..... H01Q 19/18–193

See application file for complete search history.

(56) References Cited

U.S. PATENT DOCUMENTS 4,963,878 A * 10/1990 Kildal ..... H01Q 19/134 343/781 P
6,107,973 A * 8/2000 Knop ..... H01Q 19/19 343/781 CA
6,137,449 A * 10/2000 Kildal ..... H01Q 1/42 343/781 CA (Continued)

FOREIGN PATENT DOCUMENTS

EP 3109941 A1 * 12/2016 ..... H01Q 15/08
EP 3264531 A1 * 1/2018 ..... H01Q 19/193

(Continued)

OTHER PUBLICATIONS

Abe et al., Operating Properties of Thin-Film Slot Antennas at 2.5-THz Submillimeter Wave Band, 2002, Electronics and Communications in Japan, Part 2, vol. 85, No. 11, pp. 166-173 (Year: 2002).*

*Primary Examiner* — Ab Salam Alkassim, Jr.
*Assistant Examiner* — Anh N Ho
(74) *Attorney, Agent, or Firm* — Harrington & Smith

(57) ABSTRACT

A horn feed including: a central conduit extending axially in a first direction from a first portion that is configured to be relatively distal from a sub-reflector and including a first aperture and a second portion that is configured to be relatively proximal to the sub-reflector and including a second aperture; and an interface configured to connect to a dielectric support including an outer cylindrical dielectric wall of a substantially cylindrical shape and an inner cylindrical dielectric wall of a substantially cylindrical shape, wherein the central conduit, the outer cylindrical dielectric wall and the inner cylindrical dielectric wall are co-axial.

19 Claims, 11 Drawing Sheets

(56) References Cited

U.S. PATENT DOCUMENTS

| | | | | |
|---|---|---|---|---|
| 6,724,349 | B1 * | 4/2004 | Baird | H01Q 19/19 343/781 R |
| 2003/0030590 | A1 * | 2/2003 | Gau | H01Q 13/0241 343/786 |
| 2009/0058749 | A1 * | 3/2009 | Shimoi | H01Q 1/42 343/786 |
| 2013/0057445 | A1 | 3/2013 | Simms et al. | 343/781 P |
| 2014/0247191 | A1 * | 9/2014 | Mahon | H01Q 19/191 343/781 CA |
| 2015/0091769 | A1 * | 4/2015 | Zelenski | H01Q 13/0208 343/781 CA |

FOREIGN PATENT DOCUMENTS

| | | | | |
|---|---|---|---|---|
| WO | WO-99/10950 | A2 | 3/1999 | |
| WO | WO-2019216935 | A2 * | 11/2019 | H01Q 13/06 |

* cited by examiner

FEED FOR AN ANTENNA SYSTEM COMPRISING A SUB-REFLECTOR AND A MAIN REFLECTOR

TECHNOLOGICAL FIELD

Embodiments of the present disclosure relate to a feed for an antenna system comprising a sub-reflector and a main reflector.

BACKGROUND

An antenna system can comprise a feed, a sub-reflector and a main reflector. For example, a Cassegrain antenna system comprises a feed, a convex sub-reflector and a concave reflector. In some but not necessarily all examples, the convex sub-reflector is hyperbolic and the concave main reflector is parabolic.

BRIEF SUMMARY

According to various, but not necessarily all, embodiments there is provided a horn feed comprising:

a central waveguide extending axially in a first direction from a first portion that is configured to be relatively distal from a sub-reflector and comprises a first aperture and a second portion that is configured to be relatively proximal to the sub-reflector and comprises a second aperture; and an interface configured to connect to a dielectric support comprising an outer cylindrical dielectric wall of a substantially cylindrical shape and an inner cylindrical dielectric wall of a substantially cylindrical shape, wherein the circular central waveguide, the outer cylindrical dielectric and the inner cylindrical dielectric are co-axial.

According to various, but not necessarily all, embodiments there is provided a horn feed comprising:

a central conduit extending axially in a first direction from a first portion that is configured to be relatively distal from a sub-reflector and comprises a first aperture and a second portion that is configured to be relatively proximal to the sub-reflector and comprises a second aperture; and an interface configured to connect to a dielectric support comprising an outer cylindrical dielectric of a substantially cylindrical shape and an inner cylindrical dielectric of a substantially cylindrical shape, wherein the central conduit, the outer cylindrical dielectric and the inner cylindrical dielectric are co-axial.

In some but not necessarily all examples, the interface is proximal the second portion of the central conduit.

In some but not necessarily all examples, the interface is adjacent the second portion of the central conduit.

In some but not necessarily all examples, the interface is radially offset from the second portion of the central conduit.

In some but not necessarily all examples, the interface circumscribes the second portion of the central conduit and is coaxial with the central conduit.

In some but not necessarily all examples, the interface comprises an outer cylindrical abutment surface configured to abut an inner surface of the outer cylindrical dielectric and comprises an inner cylindrical abutment surface configured to abut an inner surface of the inner cylindrical dielectric.

In some but not necessarily all examples, the interface comprises a stepped configuration, comprising an axial offset of the outer cylindrical abutment surface and the inner cylindrical abutment surface that at least partially corresponds to greater axial extent L of the outer dielectric compared to the inner dielectric.

In some but not necessarily all examples, the thickness of outer cylindrical dielectric and inner cylindrical dielectric are less than $0.1\lambda_h/\sqrt{\varepsilon r}$ where $\lambda_h$ is the shortest operational wavelength of the horn feed.

In some but not necessarily all examples, a space between the outer cylindrical dielectric and the inner cylindrical dielectric are is approximately $0.17\lambda_m$ where $\lambda_m$ is a middle operational wavelength of the horn feed.

In some but not necessarily all examples, the second portion further comprises: a dielectric ring, wherein the dielectric ring has an exterior radius equal to a radius of the central conduit and fits snugly within the central conduit, and wherein the dielectric ring is continuous in circumferential direction and is of cylindrical shape.

In some but not necessarily all examples, the second portion further comprises conductive perturbation elements, wherein the conductive perturbation elements are arranged circumferentially on an interior surface of the central conduit.

In some but not necessarily all examples, the arrangement of conductive perturbation elements is discontinuous in the circumferential direction with equal gaps between adjacent conductive perturbation elements in the circumferential direction.

In some but not necessarily all examples, the horn feed is comprised in a feed system.

In some but not necessarily all examples, the feed system comprises the horn feed and a dielectric support comprising an outer cylindrical dielectric of a substantially cylindrical shape and an inner cylindrical dielectric of a substantially cylindrical shape, wherein the central conduit, the outer cylindrical dielectric and the inner cylindrical dielectric are co-axial.

In some but not necessarily all examples, the dielectric support comprises strengthening collars.

In some but not necessarily all examples, the feed system comprises spacers are configured to prevent relative movement of an inner cylindrical dielectric and the outer cylindrical dielectric.

According to various, but not necessarily all, embodiments there is provided a horn feed comprising:

a central waveguide extending axially in a first direction from a first portion that is configured to be relatively distal from a sub-reflector and comprises a first aperture and a second portion that is configured to be relatively proximal to the sub-reflector and comprises a second aperture, wherein the second portion comprises: a dielectric ring.

According to various, but not necessarily all, embodiments there is provided a horn feed comprising:

a circular central waveguide extending axially in a first direction from a first portion that is configured to be relatively distal from a sub-reflector and comprises a first aperture and a second portion that is configured to be relatively proximal to the sub-reflector and comprises a second aperture wherein the second portion comprises: conductive perturbation elements.

According to various, but not necessarily all, embodiments there is provided a feed system comprising a horn feed comprising a circular central waveguide portion extending axially in a first direction from a first portion that is configured to be distal from a sub-reflector and comprises a first aperture and a second portion that is configured to be proximal to the sub-reflector and comprises a second aperture; and a dielectric support comprising an outer cylindrical dielectric of a substantially cylindrical shape and an inner cylindrical dielectric of a substantially cylindrical shape, wherein the circular central waveguide, the outer cylindrical dielectric and the inner cylindrical dielectric are co-axial.

According to various, but not necessarily all, embodiments there is provided examples as claimed in the appended claims.

BRIEF DESCRIPTION

Some examples will now be described with reference to the accompanying drawings in which.

DETAILED DESCRIPTION

Figure 6:
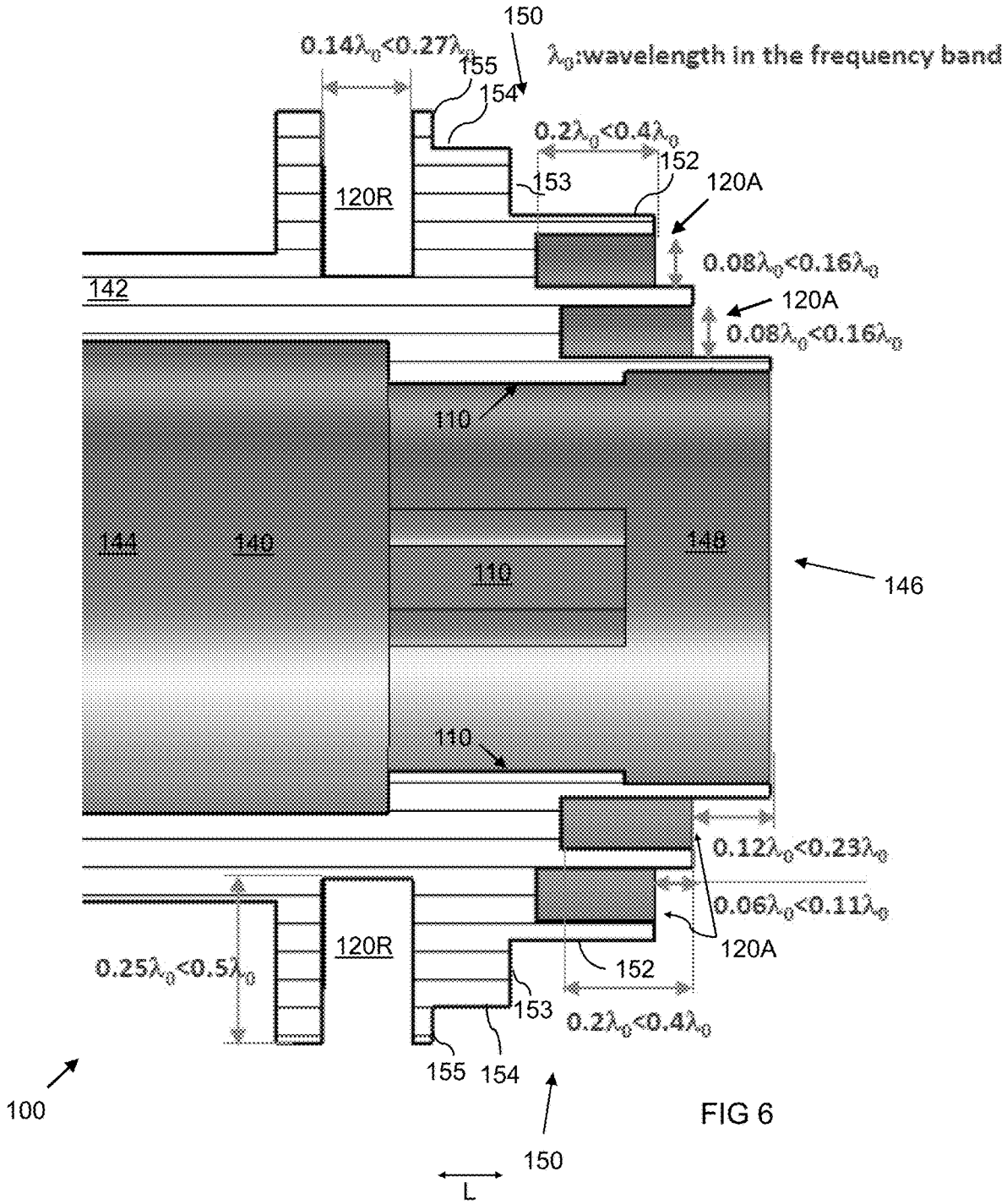
FIG. 6 shows another example of the subject matter described herein.
Figure 8:
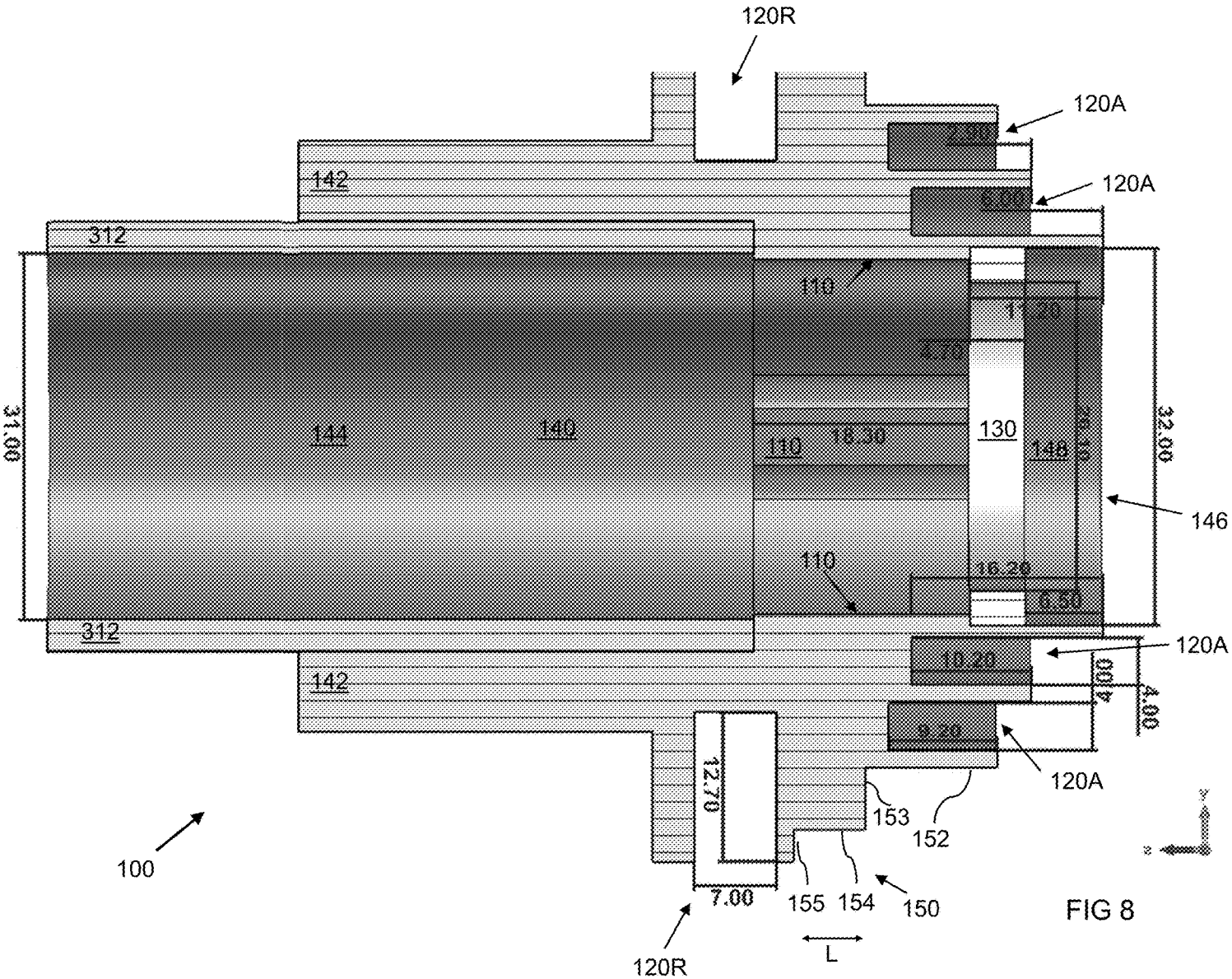
FIG. 8 shows another example of the subject matter described herein.
Figure 9:
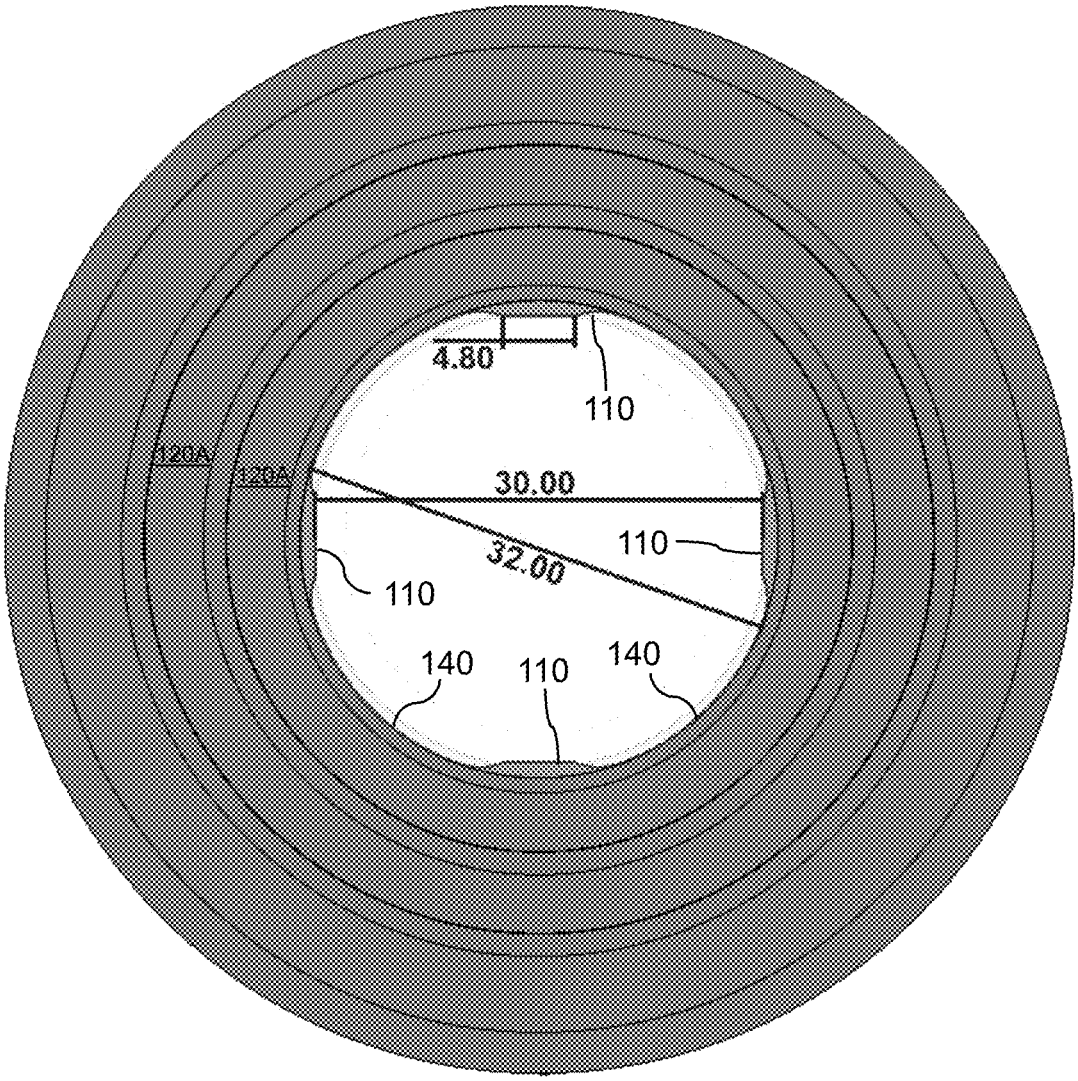
FIG. 9 shows another example of the subject matter described herein.

FIGS. 6, 8 and 9 illustrate examples of a horn feed 100 in an unassembled configuration. FIGS. 6 and 8 are longitudinal cross-section views. FIG. 9 is an end view of the horn feed illustrated in FIG. 8 along an axis of the horn feed 100 towards a portion that is to be placed proximal to a sub-reflector 320.

Figure 1A:
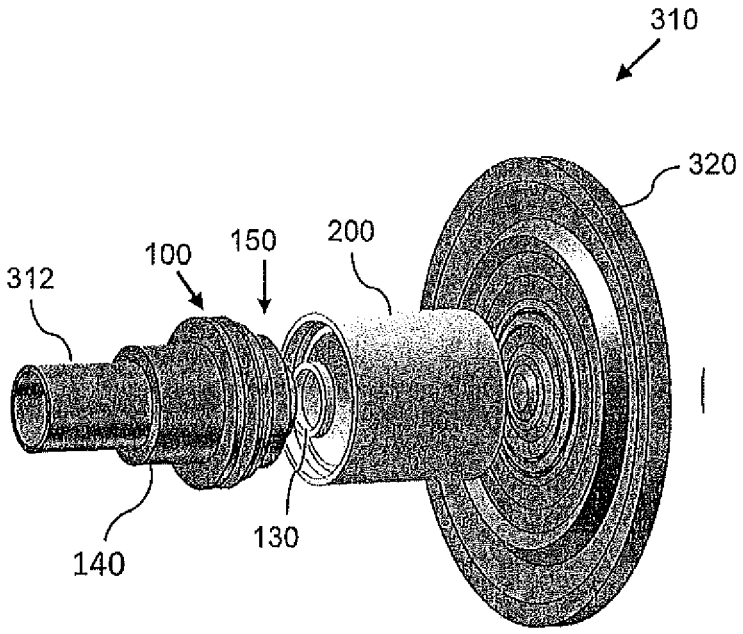
FIG. 1A, 1B, 1C show an example of the subject matter described herein.

FIG. 1A illustrates a horn feed 100 during assembly of a feed system 310. FIGS. 1B, 1C, 2A, 2B and 3 illustrate examples of an assembled feed system 310. The feed system 310 comprises a sub-reflector 320, the horn feed 100, a dielectric support 200 supporting the horn feed 100 in a spaced relationship from the sub-reflector 320, a single cylindrical waveguide 312 for providing a feed for the horn feed 100. In these examples, only a portion of the cylindrical waveguide 312 is illustrated. The cylindrical waveguide 312 connects to the horn feed 100 which connects to the dielectric support 200 which connects to the sub-reflector 320.

Figure 1B:
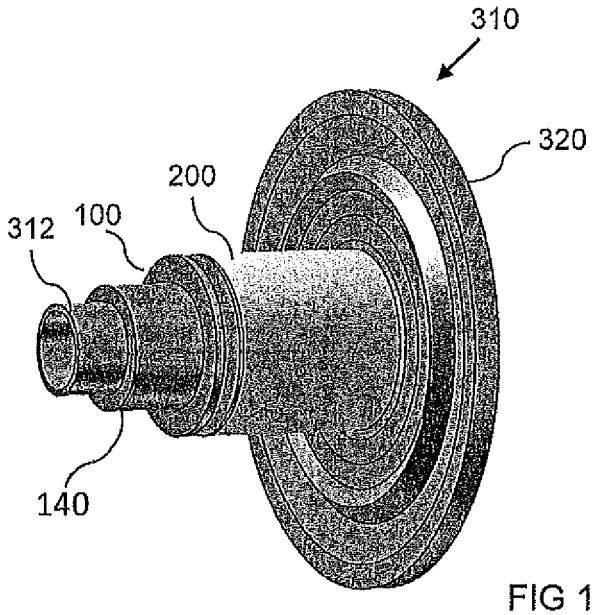
Figure 1C:
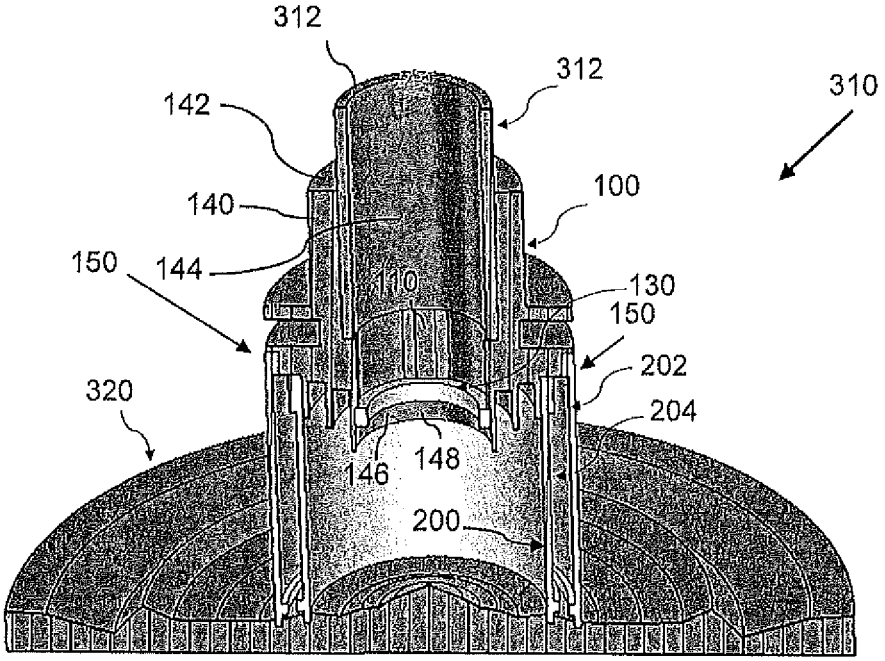

FIG. 1A is a perspective view of the feed system 310 during assembly. FIG. 1B is a perspective view of the feed system 310 after assembly. FIG. 1C is a perspective view of a longitudinal cross-section of the feed system 310 after assembly.

Figures 2A, 2B:
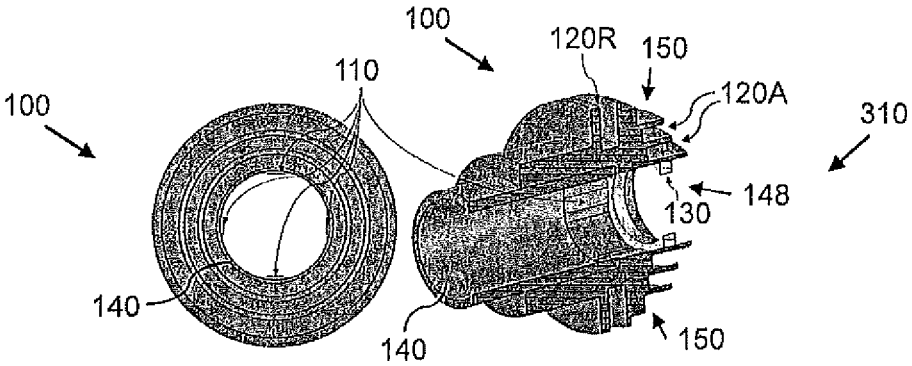
FIGS. 2A & 2B show another example of the subject matter described herein.
Figure 3:
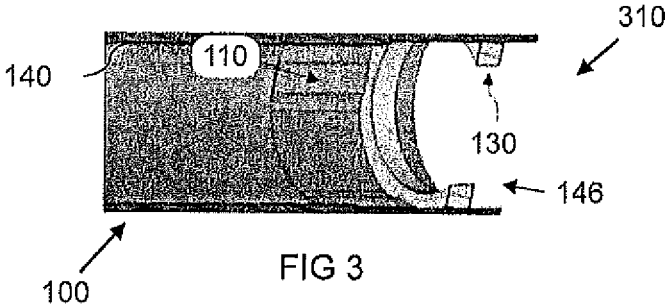
FIG. 3 shows another example of the subject matter described herein.

FIGS. 2A, 2B, 3 illustrate an example of the feed system 310 after partial assembly. In the illustrated, partially assembled state, the horn feed 100 is connected to the cylindrical waveguide 312 but the dielectric support 200 is not illustrated in these FIGS. FIG. 2A is an end view of the horn feed 100 along an axis of the horn feed 100 towards a portion that is to be placed proximal to a sub-reflector 320. FIG. 2B is a perspective view of a longitudinal cross-section of the partially assembled feed system 310. FIG. 3 is a longitudinal cross-section of the partially assembled feed system 310.

Figures 4A, 4B:
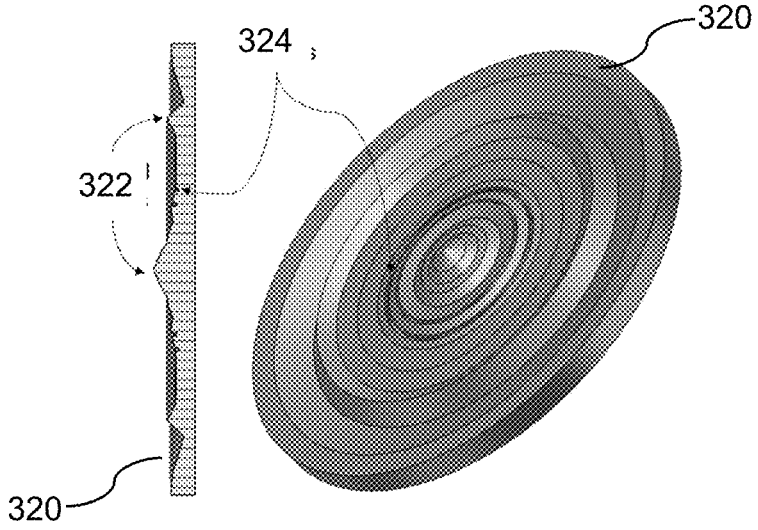
FIGS. 4A & 4B shows another example of the subject matter described herein.
Figure 12:
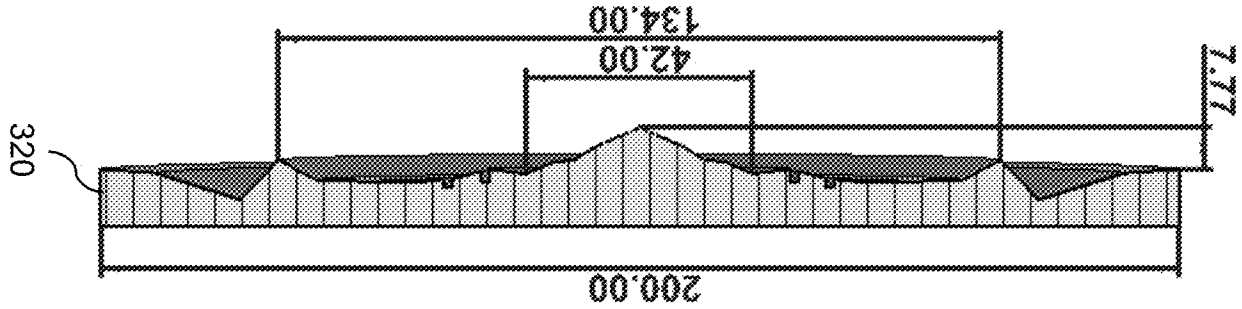
FIG. 12 shows another example of the subject matter described herein.

Examples of sub-reflectors 320 are illustrated in FIGS. 4A, 4B and FIG. 12. FIGS. 4A and 4B illustrate an example of a sub-reflector 320. FIG. 4A is a longitudinal cross-section and FIG. 4B is a perspective view of a reflecting surface of the sub-reflector 320.

The horn feed 100 comprises an interface 150 configured to connect to a dielectric support 200 between the horn feed 100 and a sub-reflector 320. The details of an example of the interface 150 are, for example, illustrated in FIGS. 1C, 6 and 8. The details of an interconnection between the interface 150 and the dielectric support 200 are, for example, illustrated in FIG. 1C.

Figure 5:
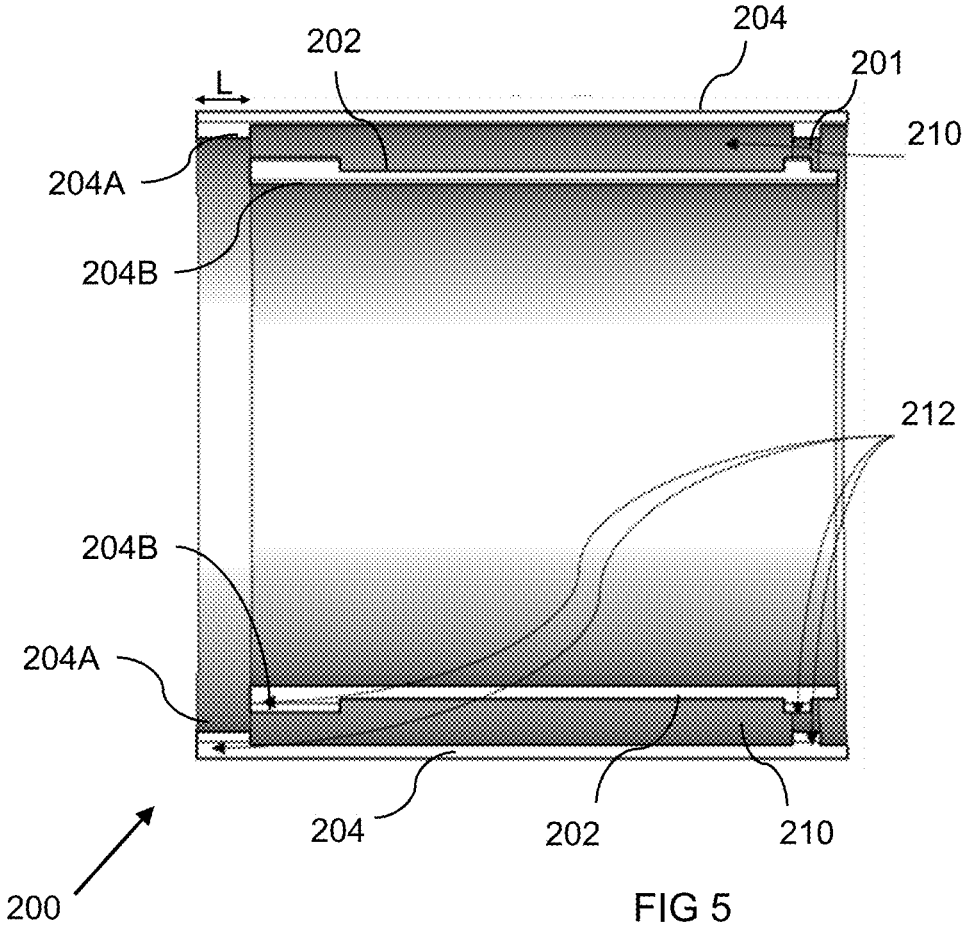
FIG. 5 shows another example of the subject matter described herein.
Figure 10:
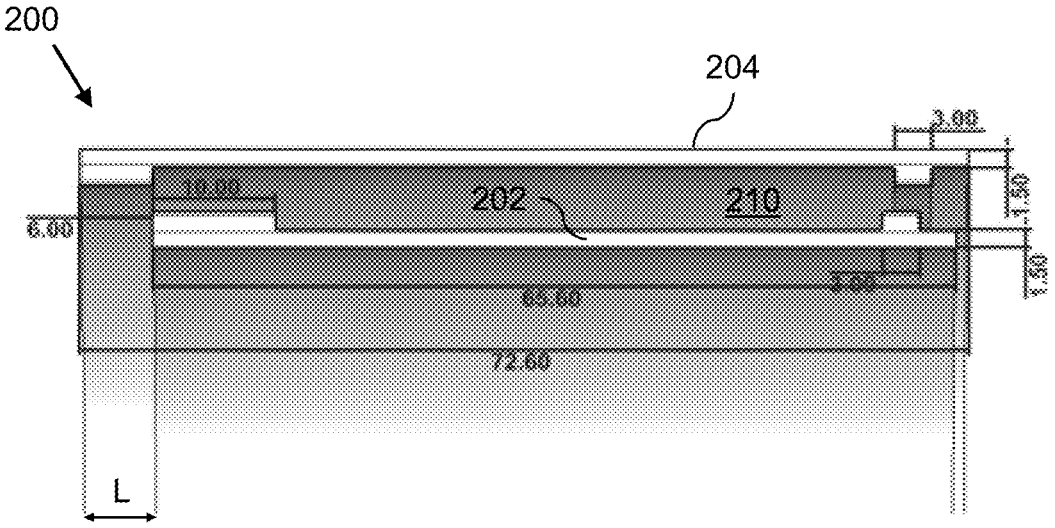
FIG. 10 shows another example of the subject matter described herein.
Figure 11:
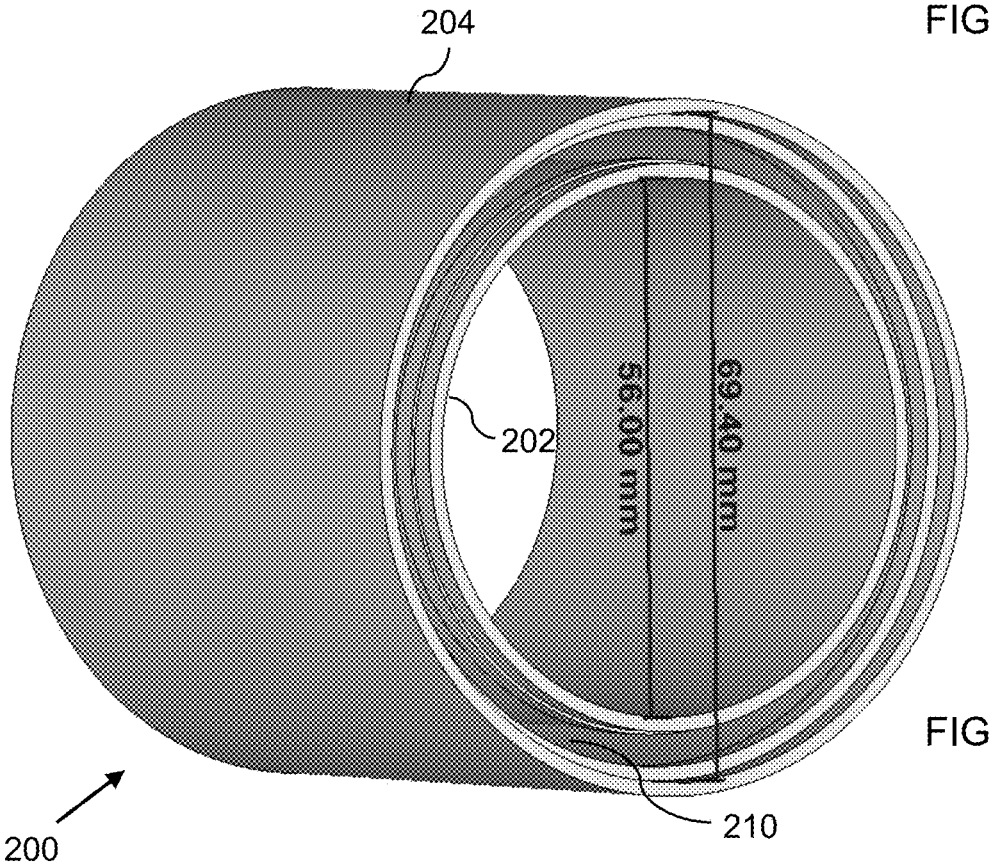
FIG. 11 shows another example of the subject matter described herein.

An example of a dielectric support 200 are illustrated in FIG. 5 and also in FIGS. 10 and 11. FIGS. 5 and 10 are longitudinal cross-sections. FIG. 11 is a perspective view. The dielectric support 200 comprising an outer cylindrical dielectric 204 of a substantially cylindrical shape and an inner cylindrical dielectric 202 of a substantially cylindrical shape, wherein the outer cylindrical dielectric 204 and the inner cylindrical dielectric 202 are co-axial.

A portion 146 of a central conduit 140 in the horn feed 100 that is towards the sub-reflector 320 comprises a dielectric ring 130. Examples of the dielectric ring 130 are illustrated in FIG. 1A, 10, 3, 8.

The portion 146 of the central conduit 140 in the horn feed 100 that is towards the sub-reflector 320 can also comprise conductive perturbation elements 110. Examples of the conductive perturbation elements 110 are illustrated in FIGS. 1C, 2A, 2B, 3, 6, 8, 9.

FIGS. 13A, 13B, 13C, 13D and 13E illustrate an example of an antenna system 300 comprising a feed system 310 and a main reflector 304.

Figure 7A:
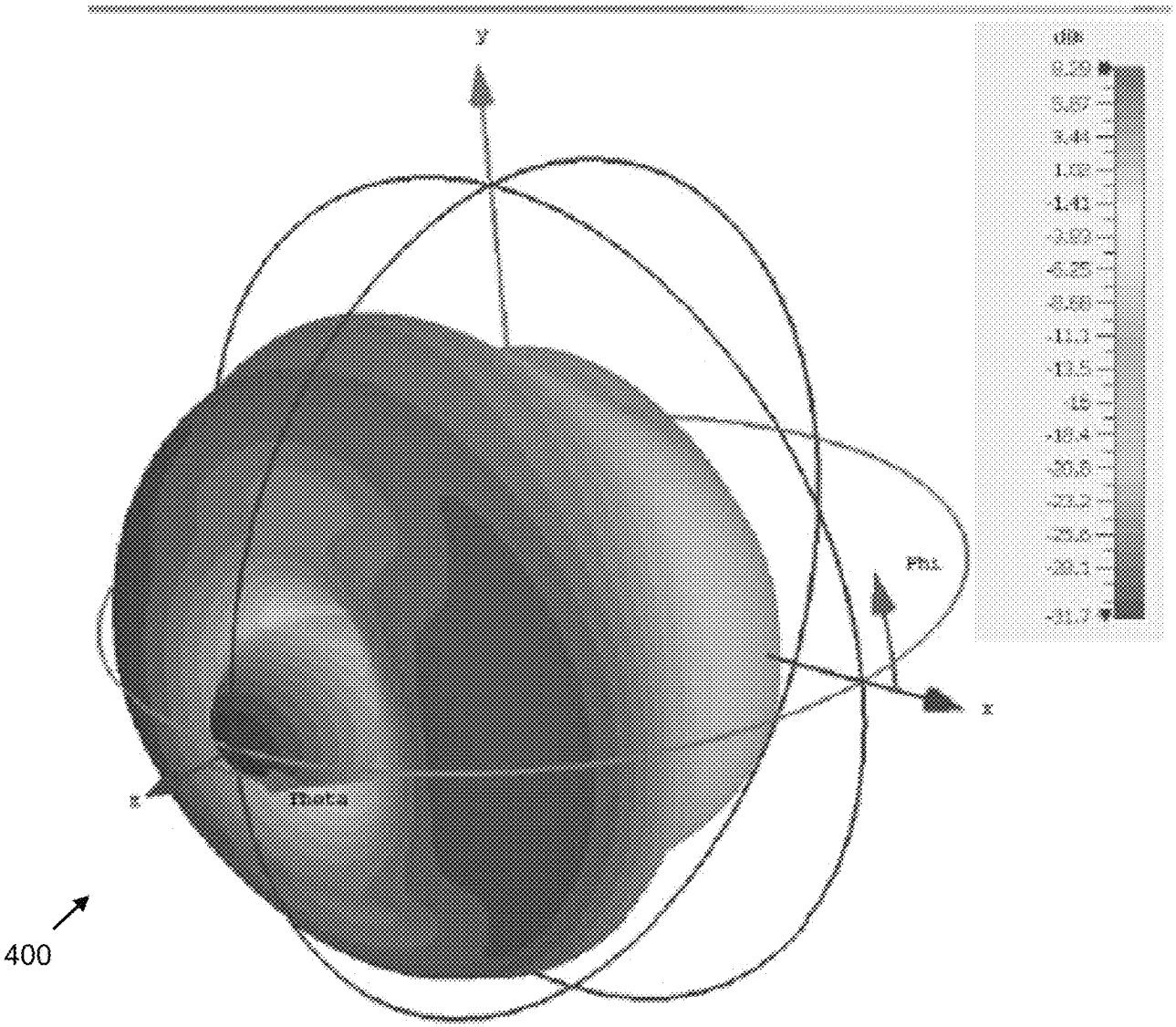
FIGS. 7A & 7B show examples of the subject matter described herein.
Figure 7B:
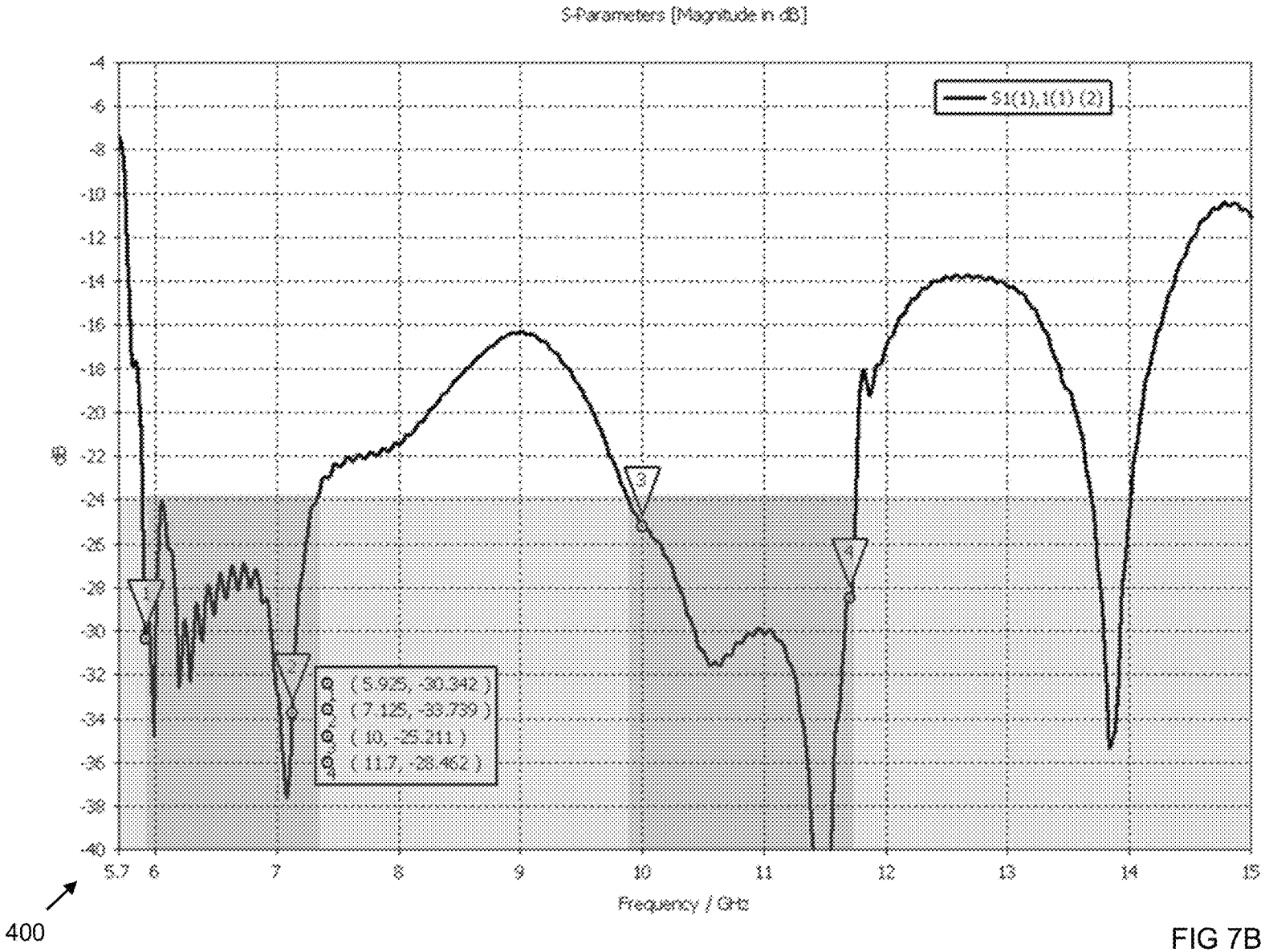

FIG. 7A illustrates an example of a radiation pattern for the feed system 310 and FIG. 7B illustrates an example of a return loss for the antenna system 300. The antenna system 300 and feed system 310 are, as illustrated in FIG. 7B multi-band. In the illustrated example, the multiple bands are microwave (above 1 GHz). In the example illustrated both are above 5 GHz.

In various examples, for example those illustrated, the horn feed 100 comprises: a central conduit 140 and an interface 150 configured to connect to a dielectric support 200.

The central conduit 140 extends axially in a first longitudinal direction between a first portion 142 and a second portion 146.

The first portion 142 is configured to be relatively distal from the sub-reflector 320 and comprises a first aperture 144.

The second portion 146 is configured to be relatively proximal to the sub-reflector 320 and comprises a second aperture 148.

The dielectric support 200 comprises an outer cylindrical dielectric 204 of a substantially cylindrical shape and an inner cylindrical dielectric 202 of a substantially cylindrical shape.

The interface 150 has a corresponding portion 155, 154 of substantially circular/cylindrical shape configured to connect to the outer cylindrical dielectric 204 and a corresponding portion 153, 152 of substantially circular/cylindrical shape configured to connect to the inner cylindrical dielectric 202.

The central conduit 140, the outer cylindrical dielectric 204 and the inner cylindrical dielectric 202 are co-axial.

As illustrated in FIGS. 10, 2B, 6 and 8 the interface 150 can be proximal the second portion 146 of the central conduit 140. In these examples, the interface 150 is adjacent the second portion 146 of the central conduit 140 and circumscribes the second portion 146 of the central conduit 140. The interface 150 is radially offset from the second portion 146 of the central conduit 140.

In at least some examples, the interface 150 comprises an outer cylindrical abutment surface 154 configured to abut the outer dielectric 204 and comprises an inner cylindrical abutment surface 152 configured to abut the inner dielectric 202. The abutment prevents or restricts radial movement of the dielectric support 200 relative to the feed horn 100.

In the examples illustrated, the outer cylindrical abutment surface 154 is configured to abut an inner surface 204A of the outer dielectric 204 and the inner cylindrical abutment surface 152 is configured to abut an inner surface 204B of the inner dielectric 202.

As illustrated in FIGS. 1C, 6 and 8, the interface 150 can comprise a stepped configuration, comprising an axial offset of the outer cylindrical abutment surface 154 and the inner cylindrical abutment surface 152 in the longitudinal direction.

The offset at least partially corresponds to an offset between longitudinal lengths of the outer dielectric 204 compared to the inner dielectric 202. The outer dielectric 204 has an axial length that is greater by L than a length of the inner dielectric 202. There is a greater axial extent L of the outer dielectric 204 compared to the inner dielectric 202.

The interface 150 comprises:

an outer annular abutment surface 155 that supports an end portion of the outer dielectric 204;

the outer cylindrical abutment surface 154 that abuts an inner surface 204A of the outer dielectric 204;

an inner annular abutment surface 153 that supports an end portion of the inner dielectric 202; and the inner cylindrical abutment surface 152 that abuts an inner surface 204B of the inner dielectric 202.

The outer annular abutment surface 155 and the inner annular abutment surface 153 are parallel and interconnected by the outer cylindrical abutment surface 154 that abuts an inner surface 204A of the outer dielectric 204. The inner radius of the annulus of the outer annular abutment surface 155 is the same as the radius of the cylinder formed by the outer cylindrical abutment surface 154 and the outer radius of the annulus of the inner annular abutment surface 153.

The interface 150 can form a friction fit with the dielectric support 200. In particular the outer cylindrical abutment surface 154 can, via abutment, form a friction fit with the inner surface 204A of the outer dielectric 204 and the inner cylindrical abutment surface 152 can, via abutment, form a friction fit with the inner surface 204B of the inner dielectric 202.

The thickness of the outer cylindrical dielectric 204 and inner cylindrical dielectric 202 can be less than $0.1\lambda_h/\sqrt{\varepsilon_r}$ where $\lambda_h$ is the shortest operational wavelength of the feed horn 100. The dielectric support can operate as a sandwich radome.

The outer annular abutment surface 155 can be sized to be the same or greater than a thickness of the outer cylindrical dielectric 204.

Dielectric Support

The space 210 between the cylindrical dielectrics 202, 204 is approximately $0.1\lambda_m/\sqrt{\varepsilon_r}$ where $\lambda_m$ is a middle operational wavelength of the feed horn 100.

The void (space 210) between the outer cylindrical dielectric 204 and inner cylindrical dielectric 202 can be filled with dielectric material or air to control $\varepsilon_r$.

The distance between the inner walls 2048, 204A of the inner and outer cylindrical dielectrics 202, 204 is equal to a width of the space 210 and the thickness of the inner cylindrical dielectric 202.

The distance between the inner walls 2048, 204A of the inner and outer cylindrical dielectrics 202, 204 can determine the radial offset between the outer cylindrical abutment surface 154 that abuts an inner surface 204A of the outer dielectric 204 and the inner cylindrical abutment surface 152 that abuts an inner surface 204B of the inner dielectric 202.

The dielectric support 200 can comprise strengthening collars 212. For example, as illustrated in FIG. 5 an exterior surface 204B of the inner cylindrical dielectric 202 comprises multiple spaced collars 212. For example, as illustrated in FIG. 5 an interior surface 204A of the outer cylindrical dielectric 204 comprises multiple spaced collars 212. In the illustrated example, the interior surface 204A of the outer cylindrical dielectric 204 comprises a collar 212 where it connects to the interface 150.

The dielectric support 200 can also comprise spacers 201 positioned between the inner cylindrical dielectric 202 and the outer cylindrical dielectric 204 that prevent relative movement of an inner cylindrical dielectric 202 and an outer cylindrical dielectric 204.

Dielectric Ring

The second portion 146 of the central conduit 140 in the horn feed 100 that is towards the sub-reflector 320 can comprise a dielectric ring 130. Examples of the dielectric ring 130 are illustrated in FIG. 1A, 1C, 3, 8.

In at least some examples, the dielectric ring 130 has an exterior radius equal to the radius of the central conduit 140 and fits snugly within the central conduit 140. The dielectric ring 130 is continuous in a circumferential direction and is of cylindrical shape.

As can be most clearly seen from FIG. 8, an axial (longitudinal) extent of the dielectric ring 130 is less than a distance of the closest edge of the dielectric ring to the second aperture 148. In this example, the distance of the closest edge of the dielectric ring 130 to the end of the central conduit 140 at the second aperture 148 is approximately 1.4 times the axial (longitudinal) extent of the dielectric ring 130.

In an example illustrated, a ratio of the inner to outer radius of the dielectric ring 130 is substantially 8/10 (e.g. 26.10/32 from FIG. 8).

In the example illustrated the axial extent of the dielectric ring 130 is substantially 30% of a radius of the central conduit 140 (e.g. (11.2-6.5)/16 from FIG. 8).

In the example illustrated an axial extent of the dielectric ring 130 is substantially 7/10 of a distance of the closest edge of the dielectric ring to the second aperture 148 (11.2-6.5)/6.5 in FIG. 8)

In the example illustrated a radial extent of the dielectric ring 130 is substantially 18-19% of a radius of the central conduit 140 (e.g. (32-26.1)/32) from FIG. 8).

In some examples, the radial extent of the dielectric ring 130 is approximately the same size as the space 210 between the cylindrical dielectrics 202 i.e. $0.1\lambda_m$.

In some examples illustrated an axial extent of the dielectric ring 130 is approximately $\lambda_m/7$.

The dielectric ring can, for example, be made from any suitable dielectric including, for example, REXOLITE®, PMMA (Poly Methyl Methacrylate), ABS (Acrylonitrite Butadiene Styrene), PVC (Polyvinyl Chloride), polypropylene, polystyrene, polycarbonate.

Perturbation Elements

The second portion 146 of the central conduit 140 in the horn feed 100 that is towards the sub-reflector 320 can also comprise conductive perturbation elements 110. Examples of the conductive perturbation elements 110 are illustrated in FIGS. 1C, 2A, 2B, 3, 6, 8, 9.

Where a dielectric ring 130 is used the dielectric ring 130 is placed between the perturbation elements 110 and the end of the central conduit 140 nearest the sub-reflector.

For example, in the examples illustrated, the dielectric ring 130 is immediately adjacent the perturbation elements 110 and more proximal to the sub-reflector 320.

In the examples illustrated, the conductive perturbation elements 110 are arranged circumferentially on an interior surface of the central conduit 140. The conductive perturbation element 110 are aligned in a circle, with no relative longitudinal offsets.

The arrangement of conductive perturbation elements 110 is discontinuous in the circumferential direction with gaps between adjacent conductive perturbation elements. The arrangement is symmetrical with equal circumferential spacing between the perturbation elements 110 (see FIGS. 2A and 9). In the examples illustrated there are four perturbation elements 110.

Each conductive perturbation element 110 has the same shape. Each conductive perturbation element 110 has the same axial cross-section that does not vary in the longitudinal direction. The axial cross-section has a thicker central portion and symmetrically tapering lateral portions.

In an illustrated example, a circumferential extent of a conductive perturbation element 110 is greater than substantially 30% of a radius of the central conduit 140 (e.g. (4.8)/16 in FIGS. 8 & 9). An axial extent of a conductive perturbation element 110 is substantially 115% of a radius of the central conduit 140 (e.g. (18.3)/16 in FIG. 8). The axial extent of a conductive perturbation element 110 is substantially 6% of a radius of the central conduit 140 (e.g. (2)/32) in FIGS. 8&9).

An axial extent of a conductive perturbation element 110 is substantially 16/10 of a distance of the closest edge of the conductive perturbation element 110 to the second aperture 148 [(18.3)/11.2 in FIG. 8]

In some examples, a circumferential extent of a conductive perturbation element 110 is around $\lambda_m/10$ In the examples, a radial extent of a conductive perturbation element 110 is around $\lambda_m/25$.

In the examples, an axial extent of a conductive perturbation element 110 is around $10\lambda_m/25$ to the closest edge of the conductive perturbation element 110 to the second aperture 148.

The horn feed 100 as previously described can, for example, comprise grooves 120. The grooves 120 can, for example, comprise one or more axial grooves 120A and/or one or more radial grooves 120R.

A radial groove 120R has, in longitudinal cross-section, a base that extends parallel to the longitudinal axis and opposing sidewalls that extend radially. The U-shape is rotated about a central longitudinal axis of the horn feed 100 to form the radial groove 120R. The sidewalls of the groove are radial.

An axial groove 120A has, in longitudinal cross-section, a base that extends radially and opposing spaced sidewalls that extend parallel to the longitudinal axis. The U-shape is rotated about a central longitudinal axis of the horn feed 100 to form the axial groove 120A. The sidewalls of the groove are axial.

In the particular examples illustrated there are two adjacent axial grooves 120A and one radial groove 120R.

The horn feed 100 can be a single metallic part. It can, for example, be a machined metallic part. The axial grooves 120A and radial groove 120R can have dimensions that are configured for low and high operational frequency bands of the feed horn 100. The grooves 120 improve the symmetry of the primary radiation pattern between the vertical and horizontal polarization, the return loss and reduce the radiation spillover.

The cylindrical waveguide 312 (pipe) can, for example, be glued inside the central conduit 140 of the horn feed 100. The interior surface of the central conduit 140 can have a step between the first portion 142 and the second portion 146 so that the interior surface of the cylindrical waveguide 312 is flush with the interior surface of the central conduit 140 at its second portion 146 (compare FIGS. 6 and 8). The detent can be formed at a distal end of the perturbation elements 110. The horn feed 100 receives and overlays an extremity of the waveguide pipe 312.

A diameter of the cylindrical waveguide 312 can be close to the frequency cutoff diameter for the lower frequency used ($F1_{min}$). If it's too high, an undesirable higher mode could appear.

FIG. 7B illustrates a return loss for the antenna system. In this example, the threshold for defining the operational frequency band is arbitrarily set at −24 dB. The Return Loss is better than 24 dB for 2 frequency ranges>1 GHz with >15% bandwidth.

The first lower frequency band is from about 5.95 to 7.25 GHz. The second higher frequency band is from about 9.9 to 11.75 GHz.

The upper frequency of the higher frequency band (11.95 GHz) is the frequency corresponding to $\lambda_h$.

The middle frequency between the upper frequency of the higher frequency band ($F2_{max}$=11.95 GHz) and the lower frequency of the lower frequency band ($F1_{min}$=5.95) is the frequency corresponding to $\lambda_m$ (e.g. (11.95+5.95)/2)

Referring to FIG. 7B, there are multiple bands of bandwidth greater than 1 GHz, over 5 GHz. In this example, $F2_{max}/F1_{min}<2$ (11.75/5.95=1.97), If instead the threshold for defining the operational frequency band is arbitrarily set at −16 dB, the between Return Loss is better than 16 dB for single large frequency range>6 GHz with >65% bandwidth The dielectric ring 130 increases the Return Loss performance. The perturbation elements 110 increase the bandwidth.

FIG. 7A illustrates a radiation pattern for the feed system 310.

The grooves 120 improve the symmetry of the primary radiation pattern between the vertical and horizontal polarization, the return loss and reduce the radiation spillover.

The shape of the sub-reflector shape 320 also controls the radiation pattern.

The primary radiation pattern has good symmetry in vertical and horizontal planes to get the best cross polarization results.

The antenna system 300 can work with two wave polarization with very high discrimination for the two frequency bands illustrated in FIG. 7B.

FIGS. 13A, 13B, 13C, 13D and 13E illustrated an example of an antenna system 300 comprising a feed system 310 and a main reflector 304.

As previously described the feed system 310 comprises a single cylindrical waveguide 312, a horn feed 100, a dielectric support 200, and a sub-reflector 320.

A path of a signal 330, for transmission, is illustrated. The signal path for reception is the reverse.

Figure 13A:
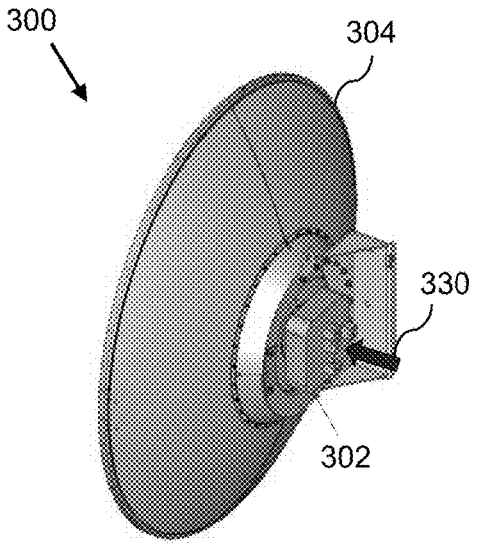
FIGS. 13A to 13E show another example of the subject matter described herein
Figure 13B:
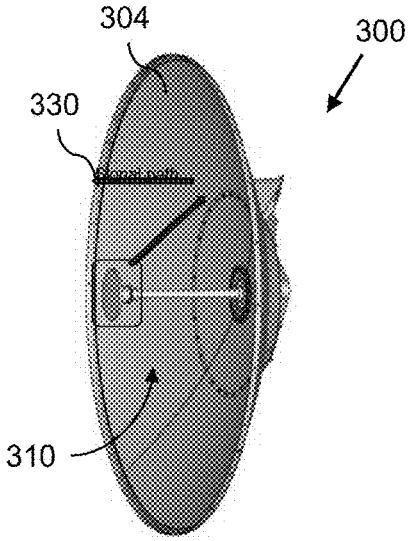
Figure 13C:
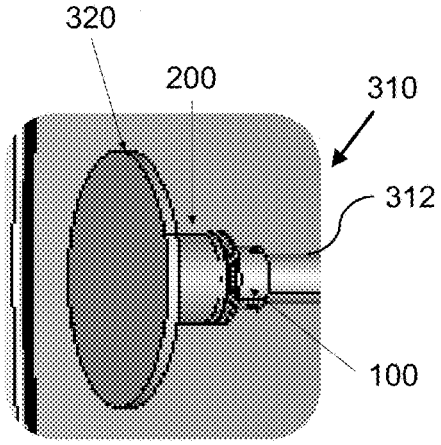
Figure 13D:
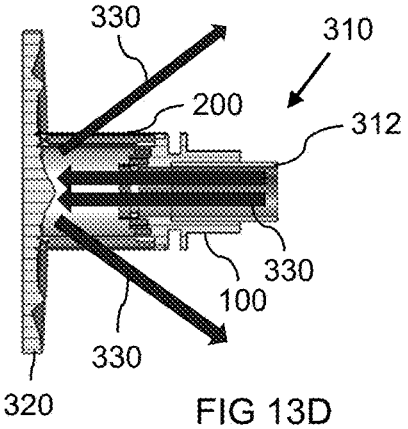

A feed 302 provides a signal 330 to the horn feed 100 via the cylindrical waveguide 312. The signal 330 passes from the horn feed 100 to the sub-reflector 320. The horn feed 100 and the sub-reflector 320 are spaced apart and interconnected via the dielectric support 200. The signal 330 is reflected by the sub-reflector towards the main reflector 304 (FIG. 13D). The signal 330 is then reflected off the main reflector 304 as a transmitted signal (FIG. 13B).

In this example, the main reflector 304 is a parabolic antenna of diameter 6 ft (1.83 m) to 12 ft (3.66 m).

In this example, the sub-reflector 320 is metallic and has a shape design that has been optimized to fulfil the RF performances for both of the frequency bands. It's a relative shape with 2 conical parts 322 and the grooves 324 to fix the dielectric support 200. Its diameter is around 200 mm for 6 Ghz. In other examples, the diameter can be approximately $4*\lambda_h$.

The central conical parts 322 of the sub-reflector 320 avoid direct reflection of the waves inside the horn. The central conical parts 322 improve the radiation spill over performance.

The antenna system has very high performances for multiple frequency bands, for example, the two frequency bands: 5.925 to 7.125 GHz and 10 to 11.7 GHz illustrated in FIG. 7B.

Figure 13E:
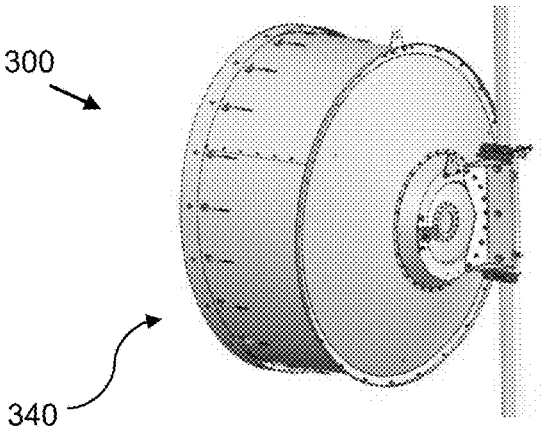

The main reflector and the feed system can be covered by a radome 340 as illustrated in FIG. 13E.

The feed system 310 can, for example be used as a Dual Band Axial Feed for Parabolic Antennas The antenna system 300 can, for example, be used for backhaul in a cellular network.

The antenna system 300 can be a Cassegrain arrangement comprising a convex sub-reflector and a concave main reflector. In some but not necessarily all examples, the convex sub-reflector is hyperbolic and the concave main reflector is parabolic.

Where a structural feature has been described, it may be replaced by means for performing one or more of the functions of the structural feature whether that function or those functions are explicitly or implicitly described.

The horn feed 100, feed system 310 and antenna system 300 may be configured to operate in a plurality of operational frequency bands. The antenna system 300 van be used for point to point links (fixed stations) and can also be used for satellite connection. The operational frequency bands can be from 3.6 GHz to 86 GHz.

A frequency band over which an antenna can efficiently operate is a frequency range where the antenna's return loss is less than an operational threshold.

The above described examples find application as enabling components of: automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one." or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although examples have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain examples, those features may also be present in other examples whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer any exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

What is claimed is:

1. A horn feed comprising:

a central conduit extending axially in a first direction from a first portion that is configured to be relatively distal from a sub-reflector and comprises a first aperture and a second portion that is configured to be relatively proximal to the sub-reflector and comprises a second aperture; and an interface configured to connect to a dielectric support, the dielectric support comprising an outer cylindrical dielectric wall of a substantially cylindrical shape and an inner cylindrical dielectric wall of a substantially cylindrical shape, wherein the central conduit, the outer cylindrical dielectric wall and the inner cylindrical dielectric wall are co-axial;

wherein the interface comprises, an outer end abutment surface configured to abut an end surface of the outer cylindrical dielectric wall, an outer cylindrical support surface configured to support an inner surface of the outer cylindrical dielectric wall, an inner end abutment surface configured to abut an end surface of the inner cylindrical dielectric wall, and an inner cylindrical support surface configured to support an inner surface of the inner cylindrical dielectric wall.

2. A horn feed as claimed in claim 1, wherein the interface is proximal the second portion of the central conduit.

3. A horn feed as claimed in claim 1, wherein the interface is adjacent the second portion of the central conduit.

4. A horn feed as claimed in claim 1, wherein the interface is radially offset from the second portion of the central conduit.

5. A horn feed as claimed in claim 1, wherein the interface circumscribes the second portion of the central conduit and is coaxial with the central conduit.

6. A horn feed as claimed in claim 1, wherein the interface comprises a stepped configuration, comprising an axial offset of an outer cylindrical abutment surface and an inner cylindrical abutment surface, wherein an axial length of the outer dielectric wall is greater than an axial length of the inner dielectric wall.

7. A horn feed as claimed in claim 1, wherein the thickness of outer cylindrical dielectric wall and inner cylindrical dielectric wall are less than $0.1\lambda_h/\sqrt{\varepsilon_x}$, where $\lambda_h$ is the shortest operational wavelength of the horn feed.

8. A horn feed as claimed in claim 1, wherein a space between the outer cylindrical dielectric wall and the inner cylindrical dielectric wall is approximately $0.17\lambda_m$ where $\lambda_m$ is a middle operational wavelength of the horn feed.

9. A horn feed as claimed in claim 1, wherein the second portion further comprises: a dielectric ring, wherein the dielectric ring has an exterior radius equal to a radius of the central conduit and fits snugly within the central conduit, and wherein the dielectric ring is continuous in circumferential direction and is of cylindrical shape.

10. A horn feed as claimed in claim 1, wherein the second portion further comprises conductive perturbation elements, wherein the conductive perturbation elements are arranged circumferentially on an interior surface of the central conduit.

11. A horn feed as claimed in claim 10, wherein the arrangement of conductive perturbation elements is discontinuous in the circumferential direction with equal gaps between adjacent conductive perturbation elements in the circumferential direction.

12. A feed system comprising: the horn feed as claimed in claim 1; and the dielectric support.

13. A feed system as claimed in claim 12, wherein the dielectric support comprises strengthening collars.

14. An antenna system comprising:

the horn feed, the dielectric support, and the sub-reflector as claimed in claim 1; and a main reflector.

15. A feed system comprising:

a horn feed comprising:

a central conduit extending axially in a first direction from a first portion, where the first portion is configured to be distal from a sub-reflector and comprises a first aperture, and a second portion that is configured to be proximal to the sub-reflector, where the second portion comprises a second aperture; and an interface; and a dielectric support comprising:

an outer cylindrical dielectric wall of a substantially cylindrical shape; and an inner cylindrical dielectric wall of a substantially cylindrical shape, the interface being configured to connect to the dielectric support;

wherein the central conduit, the outer cylindrical dielectric wall and the inner cylindrical dielectric wall are co-axial; and wherein the interface comprises, an outer end abutment surface configured to abut an end surface of the outer cylindrical dielectric wall, an outer cylindrical support surface configured to support an inner surface of the outer cylindrical dielectric wall, an inner end abutment surface configured to abut an end surface of the inner cylindrical dielectric wall, and an inner cylindrical support surface configured to support an inner surface of the inner cylindrical dielectric wall.

16. A feed system as claimed in claim 15, wherein the dielectric support comprises strengthening collars.

17. An antenna comprising: a horn feed comprising: a central conduit extending axially in a first direction from a first portion to a second portion, where the first portion comprises a first aperture, and where the second portion comprises a second aperture; and an interface configured to connect to a dielectric support comprising an outer cylindrical dielectric wall of a substantially cylindrical shape and an inner cylindrical dielectric wall of a substantially cylindrical shape, wherein the central conduit, the outer cylindrical dielectric wall and the inner cylindrical dielectric wall are co-axial, wherein the interface comprises, an outer end a butment surface configured to abut an end surface of the outer cylindrical dielectric wall, an outer cylindrical support surface configured to support an inner surface of the outer cylindrical dielectric wall, an inner end abutment surface configured to a but an end surface of the inner cylindrical dielectric wall, and an inner cylindrical support surface configured to support an inner surface of the inner cylindrical dielectric wall;

the dielectric support;

a sub-reflector; and a main reflector;

where the first portion is configured to be distal from the sub-reflector and where the second portion is configured to be proximal to the sub-reflector.

18. The antenna as claimed in claim 17, wherein the interface is proximal the second portion of the central conduit.

19. The antenna as claimed in claim 18, wherein the interface is adjacent the second portion of the central conduit.

* * * * *